US007400855B2

(12) United States Patent
Bokelman et al.

(10) Patent No.: US 7,400,855 B2
(45) Date of Patent: Jul. 15, 2008

(54) WINDING MEDIA

(75) Inventors: Kevin Bokelman, San Diego, CA (US); Glenn W. Gaarder, Ramona, CA (US); William Wistar Rhoads, Ramona, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 11/046,036

(22) Filed: Jan. 27, 2005

(65) Prior Publication Data

US 2006/0165453 A1 Jul. 27, 2006

(51) Int. Cl.

| | |
|---|---|
| ***B65H 15/00*** | (2006.01) |
| *B41J 2/01* | (2006.01) |
| *G03G 15/00* | (2006.01) |

(52) U.S. Cl. ..... 399/401; 399/364; 271/291; 347/104

(58) Field of Classification Search ..... None
See application file for complete search history.

(56) References Cited

U.S. PATENT DOCUMENTS

| | | | | |
|---|---|---|---|---|
| 4,204,471 | A | 5/1980 | Becker | |
| 4,496,142 | A * | 1/1985 | Iwasaki | 271/3.03 |
| 5,740,510 | A * | 4/1998 | Van den Bogaert et al. | 399/298 |
| 5,772,343 | A | 6/1998 | Beretta | |
| 6,183,406 | B1 | 2/2001 | Barrus | |
| 6,203,007 | B1 | 3/2001 | Choi | |
| 6,307,614 | B1 | 10/2001 | Gaarder | |
| 6,350,072 | B1 | 2/2002 | Nunes | |
| 6,435,088 | B2 | 8/2002 | Fujimoto | |
| 6,460,991 | B1 * | 10/2002 | Temple et al. | 347/104 |
| 6,493,060 | B2 | 12/2002 | Gaarder | |
| 6,644,187 | B2 | 11/2003 | Okamoto | |
| 6,666,602 | B2 | 12/2003 | Johnson | |
| 6,823,786 | B1 | 11/2004 | Shmaiser | |

FOREIGN PATENT DOCUMENTS

| | | | |
|---|---|---|---|
| FR | 2751315 | * | 1/1998 |
| JP | 02033040 A | * | 2/1990 |

* cited by examiner

*Primary Examiner*—Daniel J. Colilla
*Assistant Examiner*—'Wynn' Q Ha

(57) ABSTRACT

Embodiments of device and methods for winding media are illustrated and described.

7 Claims, 7 Drawing Sheets

$$\frac{\omega_r}{\omega_c} \geq \frac{r_c + r_r}{r_r}$$

$\omega_r$ = THE ANGULAR VELOCITY OF THE WINDING MEMBER $\omega_c$ = THE ANGULAR VELOCITY OF THE CARRIER $r_r$ = THE RADIUS OF THE WINDING MEMBER $r_c$ = THE DISTANCE OF THE CENTER OF THE WINDING MEMBER TO THE CARRIER CENTER

WINDING MEDIA

BACKGROUND

Duplexing sheet media can be difficult. For example, apparatus for duplexing media may be large and may add significantly to an overall size of an imaging device. For longer media, the duplexing apparatus may provide a longer media path, thereby further increasing the size of the imaging device.

DETAILED DESCRIPTION

Figure 1:
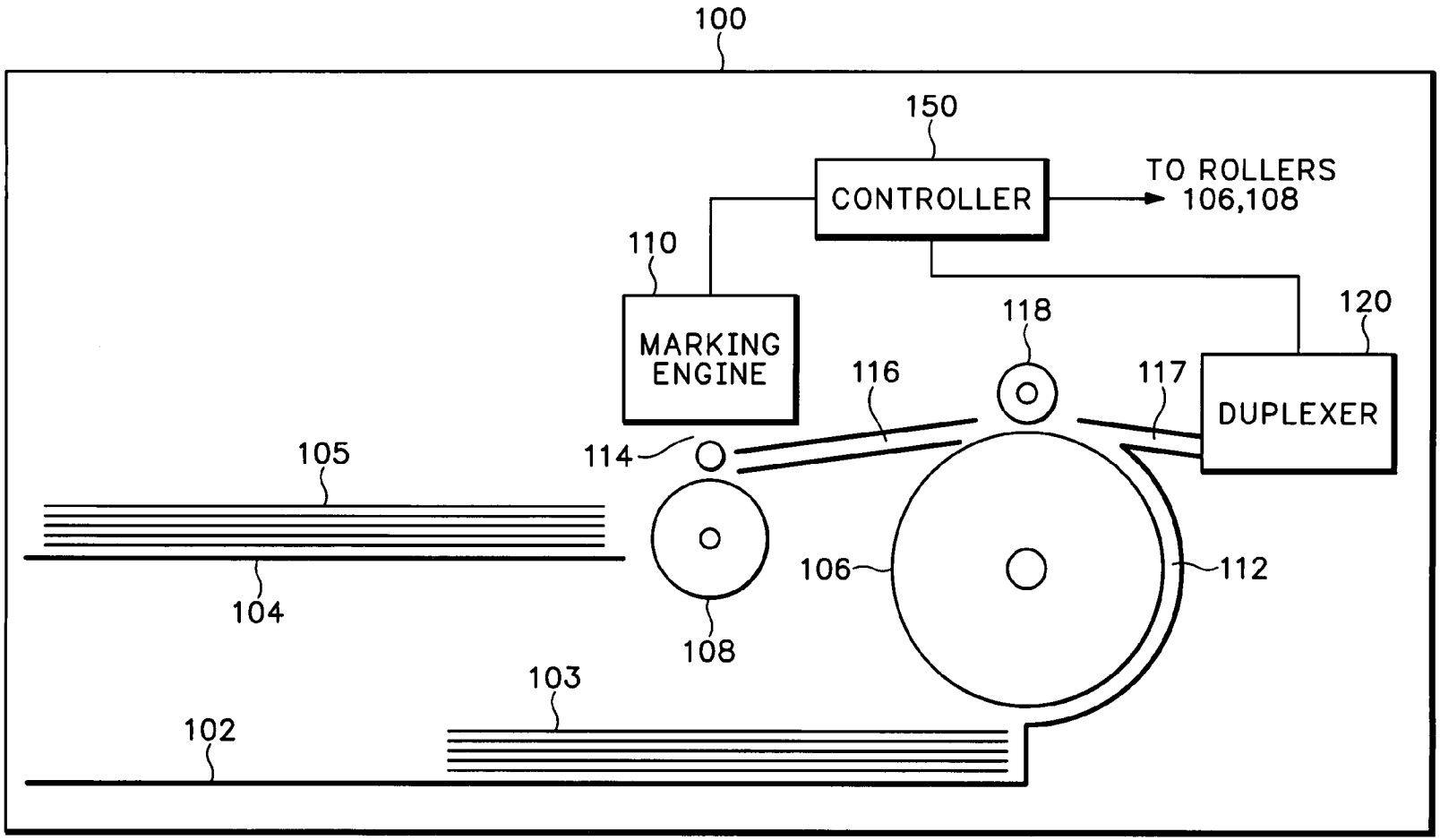
FIG. 1 illustrates an example embodiment of an imaging device.

FIG. 1 illustrates an example embodiment of an imaging device 100. The imaging device 100 may comprise an inkjet printer, a laser printer, a photocopier, scanner, multifunction device, or the like.

As illustrated, the imaging device 100 includes a media input tray 102 having media 103 therein, and a media output tray 104 having media 105. A pick roller 106 is positioned proximate the media input tray 102 and is configured to pick media 103 disposed at the input tray 102 and to advance the media 103 along path 112 to a print zone 114 via path 116. A marking engine 110, such as an inkjet print engine, is configured to at least partially form one or more images on the media while the media is positioned in the print zone 114.

The media may then be advanced directly from the print zone 114 to the output tray 104. Alternatively, the media may be advanced from the print zone 114, along paths 116, 117, to a duplexer 120. The duplexer 120 serves to flip over the media to permit imaging on an opposite side of the media. In some embodiments, the pick roller 106 and the associated pinch roller 118 advance media along paths 116, 117 from the print zone 114 to the duplexer 120.

The duplexer 120 serves to receive media, flip the media, and then output the flipped media. Restated, the duplexer 120 receives media having a first side facing a first direction, such as upward, and outputs the media so that the first side faces in a second direction, such as downward, the second direction being opposite the first direction.

Hence, the duplexer 120 may receive media after a first side of the media has been at least partially imaged by the marking engine 110. Here, the first side of the media may be facing up. The duplexer 120 then flips the media over so that the first side of the media now faces down. The duplexer 120 then outputs the media.

In some embodiments, the duplexer 120 winds, or spools the media therein. The winding may permit, in some embodiments, an entire length of the media to be substantially within the duplexer 120 before the duplexer 120 outputs a substantial portion of the media.

A controller 150 is provided, which generally comprises a processor unit configured to direct the operation of one or more components of device 100. For purposes of the disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 150 is not limited to any specific combination of hardware circuitry and software, or to any particular source for the instructions executed by the processing unit. In some embodiments, the controller 150 controls operation of the duplexer 120, the various driven rollers, and the marking engine 110. Instructions for performing the methods disclosed herein may be stored in computer readable media at the controller 150.

FIGS. 2-8 illustrate details of an example embodiment of the duplexer 120 of FIG. 1. The duplexer 120 shown in FIG. 2 includes an input roller 202 and an output roller 204. The input roller 202 is positioned adjacent a pinch roller 206 to form a nip between the input roller 202 and the pinch roller 206. Media 210 passes through the nip between the input roller 202 and the pinch roller 206 as the input roller 202 rotates. Similarly, the output roller 204 is positioned adjacent a pinch roller 208 to form a nip between the output roller 204 and the pinch roller 208. The media 210 also passes through the nip between the output roller 204 and the pinch roller 208 as the output roller 204 rotates. The rollers 202, 204, 206, and 208, in some embodiments, may be disposed outside or external the duplexer 120 and may also serve other media handling functions, such as, for example, picking media from a stack of media (not shown). As a non-limiting example, the functions of one or more of the rollers 202, 204 may be performed by the pick roller 106 (FIG. 1), in some embodiments. Moreover, in some embodiments, the rollers 202 and 204 are controlled by a suitable controller, such as the controller 150 (FIG. 1).

The duplexer 120 also includes winding members 220 and 222. For ease of reference in the drawings, member 220 is designated with an "A" and member 222 is designated with a "B". The winding members 220 and 222 are positioned on a rotatable carrier 226. The members 220 and 222, in some embodiments, may comprise actively-driven rollers. In other embodiments, the members 220 and 222 are not actively driven, but are coupled to the carrier 226 so as to rotate freely relative to the carrier 226. In other embodiments, the members 220 and 222 comprise shafts that extend from the carrier 226 and that do not rotate relative to the carrier 226. In embodiments where the winding members 220 and 222 comprise actively-driven rollers, the rotation of the members 220, 222 may be controlled by a suitable controller, such as the controller 150.

Figure 2:
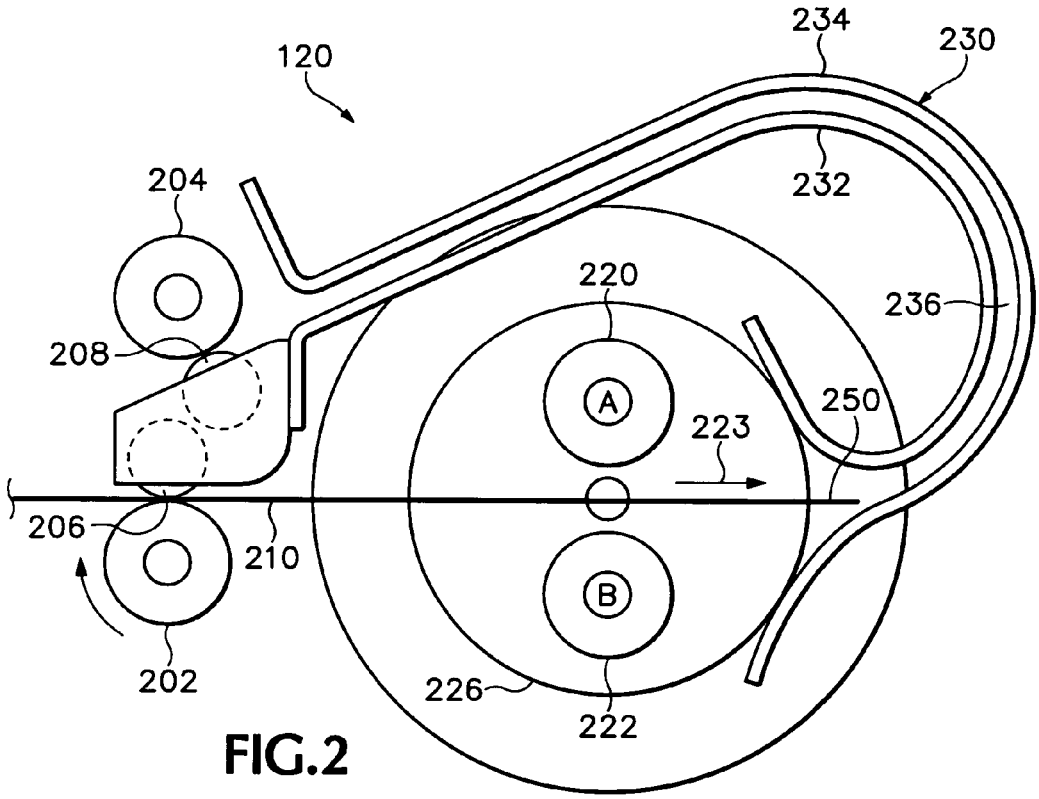
FIG. 2 illustrates details of an example embodiment of a duplexer.

With reference to FIG. 2, media 210 enters the duplexer 120 under the influence of input roller 202 and pinch roller 206, which advance the media 210 between the winding members 220 and 222 in direction 223. The media 210 is generally advanced toward a media guide 230 having an inner wall 232 and an outer wall 234. The inner wall 232 and the outer wall 234 of the media guide 230 define at least a portion of media path 236. The input roller 202 advances the media 210 into the media guide 230 and along the media path 236.

Figure 3:
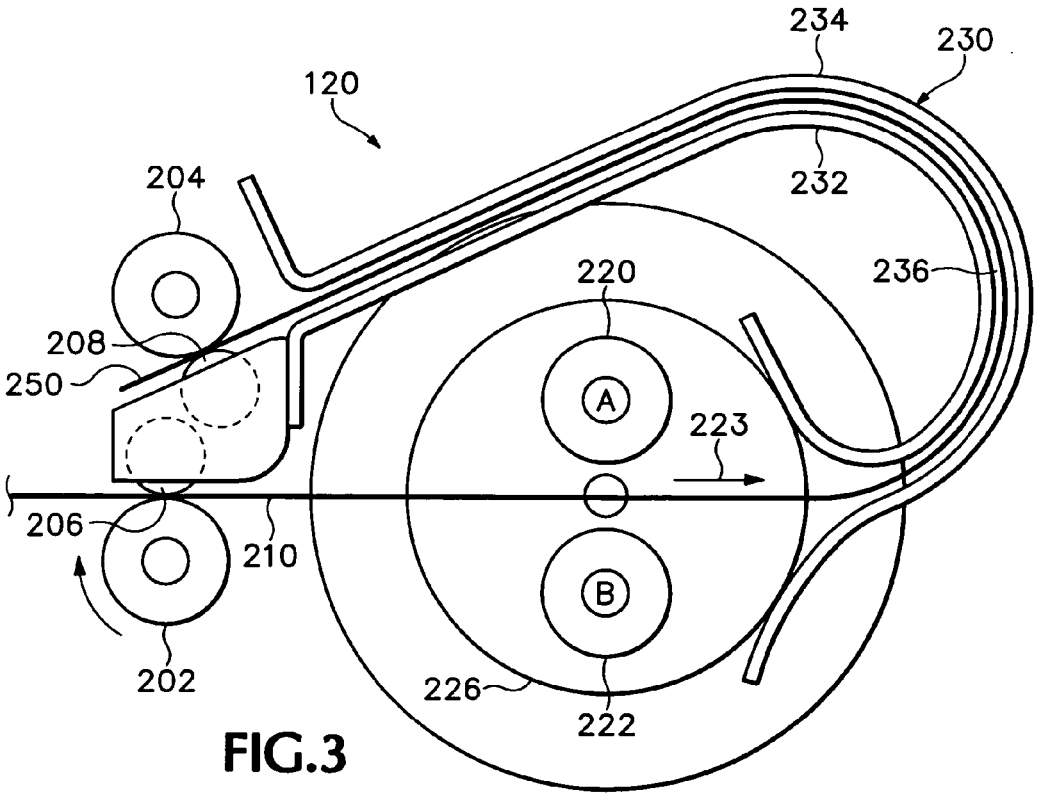
FIG. 3 illustrates the duplexer of FIG. 2 with media in a different position, according to an example embodiment.

With reference to FIG. 3, the input roller 202 continues to advance the media 210 along the media path 236 until a portion 250 of the media 210 contacts the output roller 204 and enters the nip formed between the rollers 204 and 208. After the portion 250 of the media 210 is disposed in the nip formed between the rollers 204 and 208, the controller 150 halts rotation of the roller 204, thereby causing the portion 250 of the media 210 to be grabbed and maintained between the rollers 204, 208. That is, the roller 204 stalls after the portion 250 of the media 210 enters in the nip between rollers 204, 208. Hence, in the configuration shown in FIG. 3, the portion 250 is temporarily immobilized by the output roller 204.

Figure 4:
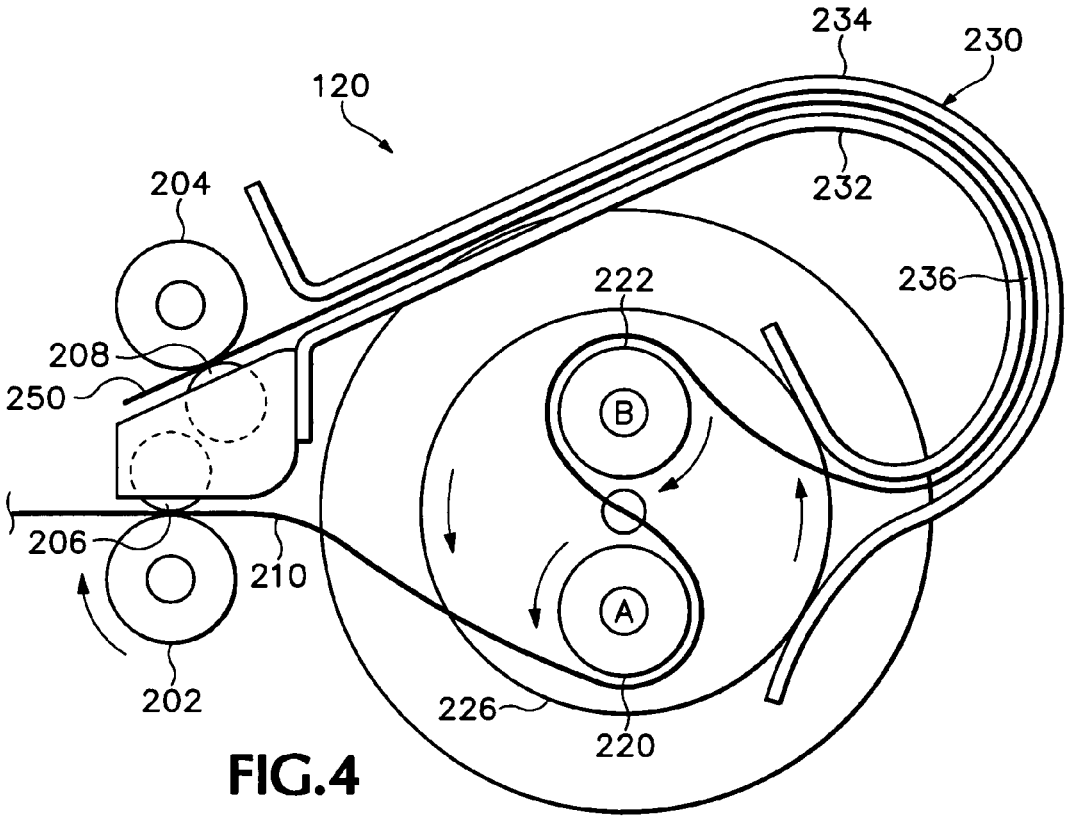
FIG. 4 illustrates the duplexer of FIG. 2 with media in a different position, according to an example embodiment.

As shown in FIG. 4, with the portion 250 of the media 210 held at the roller 204, the carrier 226 begins to rotate to wind the media 210 about the winding members 220, 222. In the embodiment shown in FIG. 4, the carrier 226 rotates in a counterclockwise direction. The winding members 220, 222, in this example embodiment, also begin to rotate in opposite directions, with winding member 220 rotating in a counterclockwise direction and the winding member 222 rotating in a clockwise direction. As the carrier 226 rotates, the winding members 220, 222 wind the media 210 about the winding members 220, 222. This winding of the media 210 about the winding members 220, 222 permits substantial amounts of the media 210 to be advanced by the roller 202 into the duplexer 120 without advancing the portion 250 of the media 210 further. As such, the length of the path 236 may be significantly shorter than the length of the media 210 being duplexed.

Figure 5:
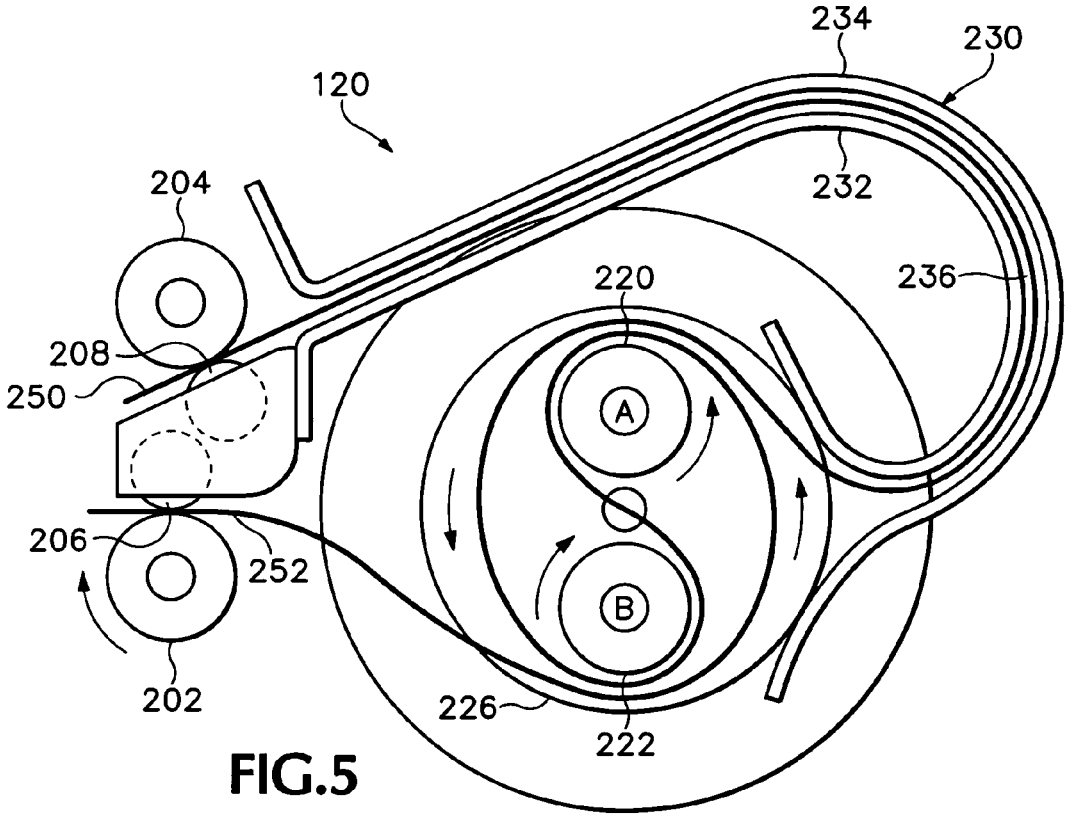
FIG. 5 illustrates the duplexer of FIG. 2 with media in a different position, according to an example embodiment.

With reference to FIG. 5, the carrier 226 and the winding members 220, 222 continue to rotate in the same directions as shown in FIG. 4. FIG. 5 illustrates the carrier 226 rotates about 180 degrees from the position shown in FIG. 4. As shown in FIG. 5, a substantial portion of the media 210 is wrapped about the winding members 220, 222 while the portion 250 of the media 250 is held at the roller 204. In a non-limiting example embodiment, approximately 19 inches (48.3 centimeters) of media may be positioned within the duplexer 120 when the media is wound as shown in FIG. 5. In other embodiments a greater amount or a lesser amount of media may be positioned within the duplexer 120. Moreover, portion 252 is shown in FIG. 5 as being positioned in the nip between rollers 202, 206.

In some embodiments, when portion 252 of the media 210 is in the nip between rollers 202, 206, the winding operation is complete. Pursuant to other embodiments, the winding operation may complete sooner, depending factors such as the length of the media and the length of the path 236.

Figure 6:
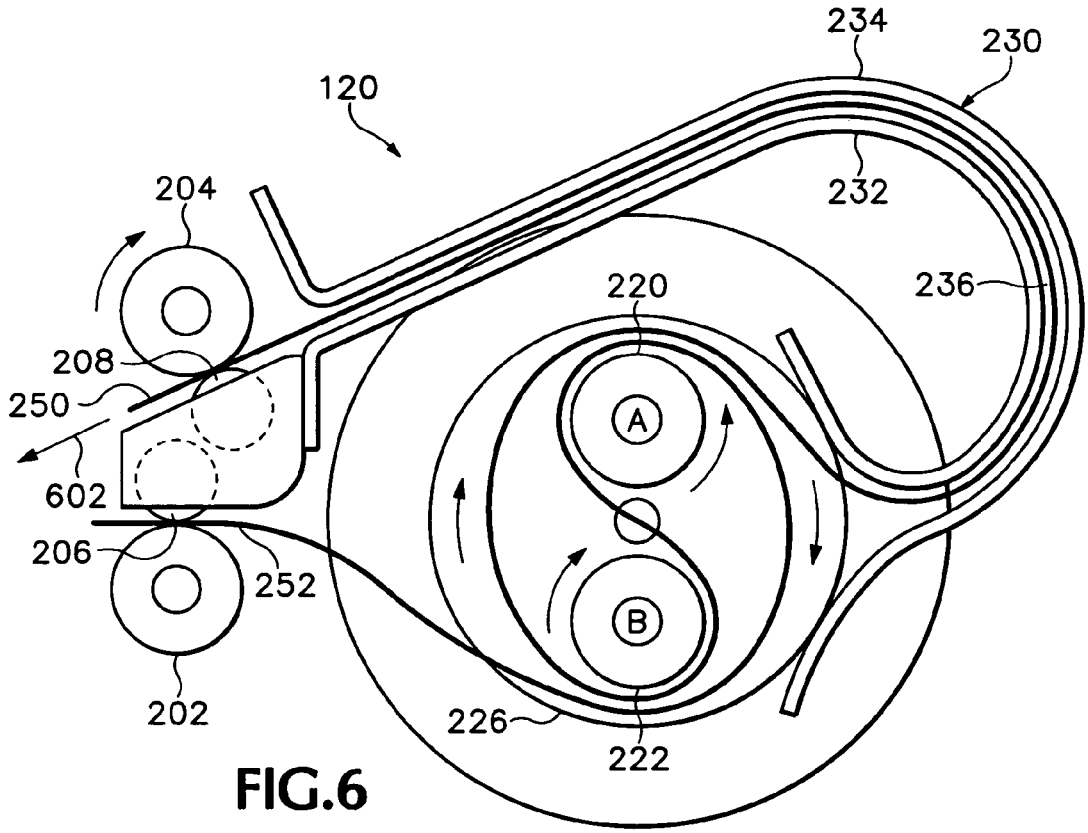
FIG. 6 illustrates the duplexer of FIG. 2 with media in a different position, according to an example embodiment.

FIG. 6 illustrates media 210 being unwound from the winding members 220, 222. In particular, FIG. 6 illustrates the roller 202 stationary with the portion 252 of the media 210 being held, or grabbed, in the nip between the roller 202 and the roller 206. In FIG. 6, the output roller 204 rotates clockwise to advance the media 210 out of the duplexer 120 to the path 117 (FIG. 1). Moreover, in FIG. 6, the carrier 226 reverses direction and rotates clockwise (in the direction opposite that of the winding operation shown in FIGS. 4, 5) to unwind the media 210 wrapped around the winding members 220, 222. In the embodiment shown in FIG. 6, the winding members 220, 222 rotate in the same directions as shown in FIGS. 4, 5. Thus, as shown in FIG. 6, the roller 202 holds portion 252 of the media 210 while the carrier 226 unwinds media 210 wrapped around the winding members 220, 222 and the roller 204 rotates to advance the media 210 in direction 602 out of the duplexer 120 via path 117 (FIG. 1).

Figure 7:
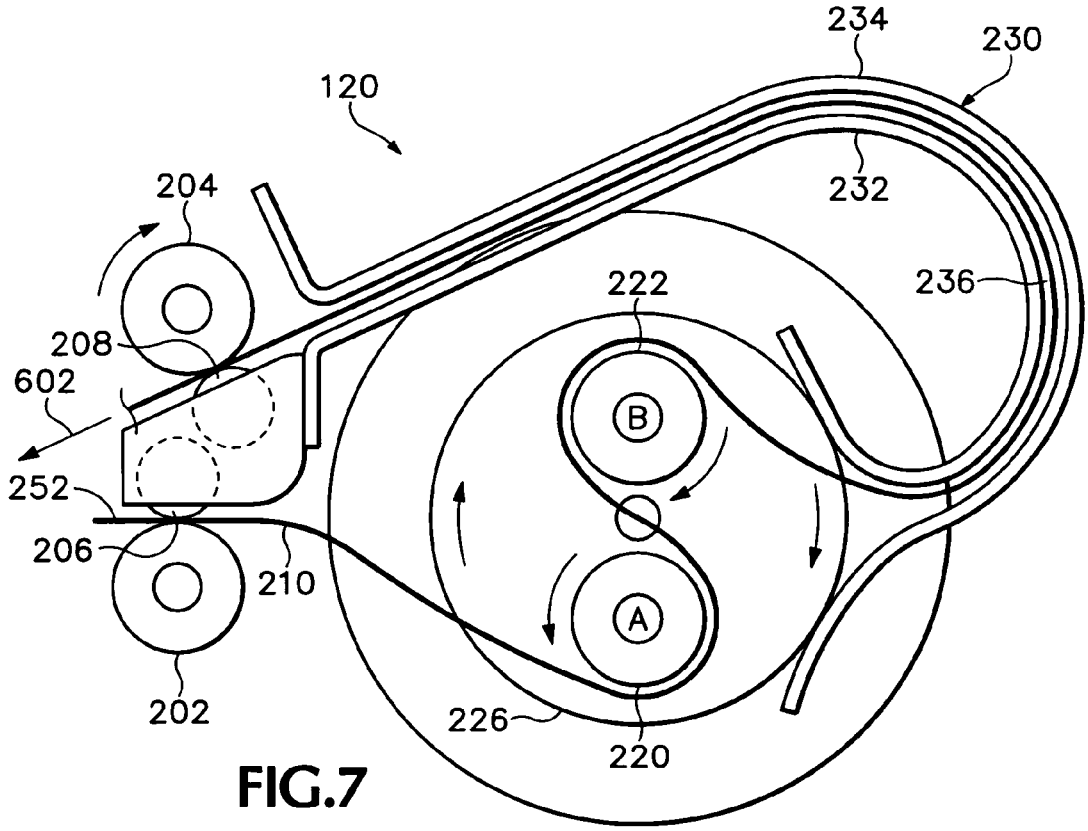
FIG. 7 illustrates the duplexer of FIG. 2 with media in a different position, according to an example embodiment.

FIG. 7 illustrates a position of the duplexer 120 wherein the duplexer 120 continues to unwind the media 210 from around the winding members 220, 222. Similar to, FIG. 6, FIG. 7 illustrates the roller 202 stationary with the portion 252 of the media 210 being held, or grabbed, in the nip between the roller 202 and the roller 206. In FIG. 7, the output roller 204 rotates to advance the media 210 and out of the duplexer 120 to the path 117 (FIG. 1). Moreover, in FIG. 7, the carrier 226 rotates clockwise (in the direction opposite that of the winding operation shown in FIGS. 4, 5) to unwind the media 210 wrapped around the winding members 220, 222. In the embodiment shown in FIG. 7, the winding members 220, 222 rotate in the same directions as shown in FIGS. 4, 5, 6. In FIG. 7, the carrier 226 is rotated about 180 degrees in clockwise direction from the position shown in FIG. 6. Thus, as shown in FIG. 7, the roller 202 continues to hold portion 252 of the media 210 while the carrier 226 unwinds media 210 wrapped around the winding members 220, 222 and the roller 204 rotates to advance the media 210 out of the duplexer 120 via path 117 (FIG. 1).

Figure 8:
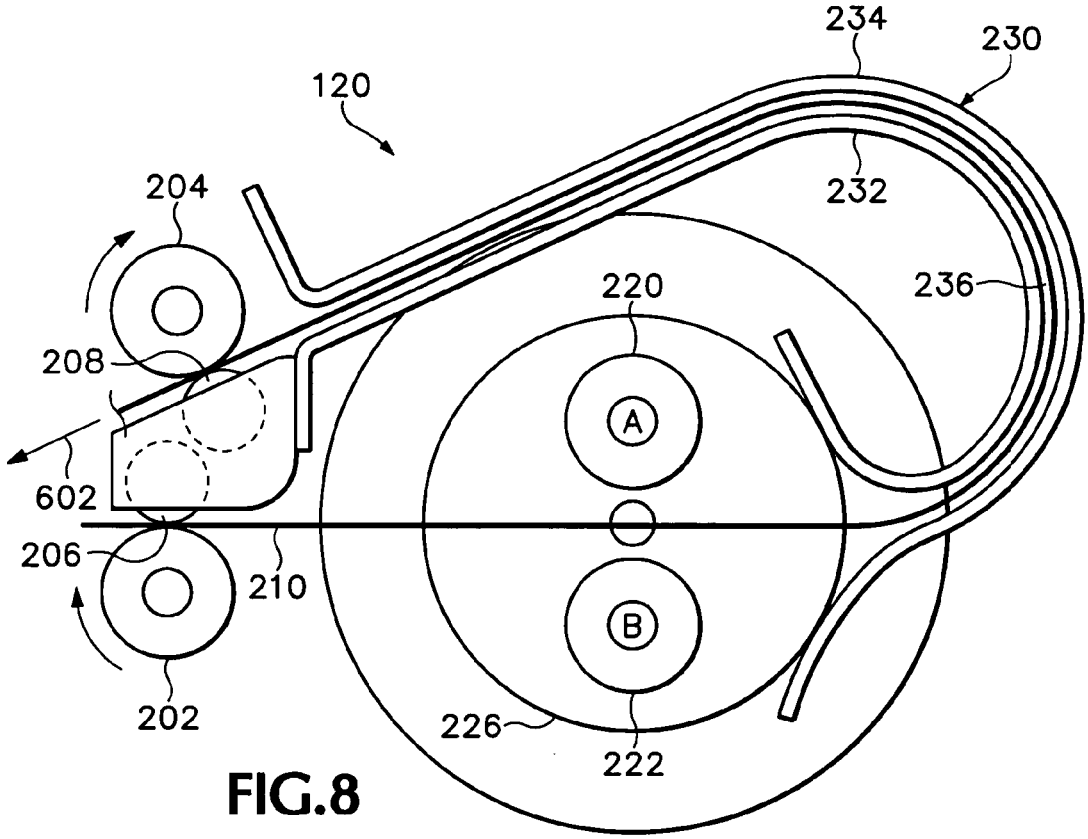
FIG. 8 illustrates the duplexer of FIG. 2 with media in a different position, according to an example embodiment.

FIG. 8 illustrates a position of the duplexer 120 wherein the media 210 is unwound from the winding members 220, 220 and both the input roller 202 and the output roller rotate to advance the media 210 through along the path 236 and out of the duplexer 120 via path 117. The roller 204 continues to rotate until the media 210 has passed through the nip between the roller 204 and the roller 208. The roller 202 may or may not continue to rotate after the media 210 has completely passed through the nip between the roller 202 and the roller 206.

Figure 9:
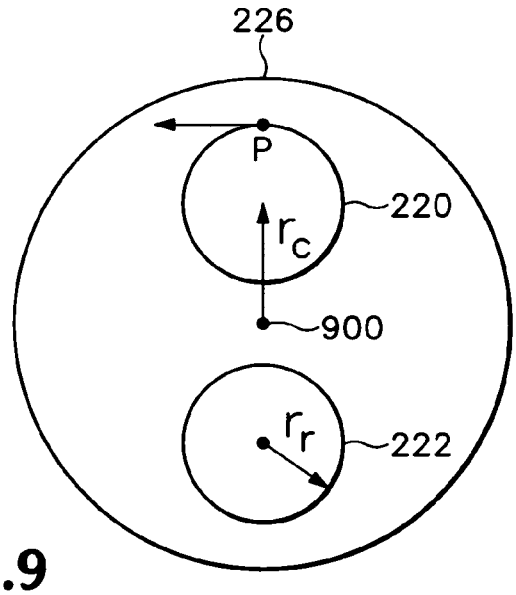
FIG. 9 illustrates example relative dimensions of an example duplexer in accordance with an embodiment.

FIG. 9 illustrates example relative dimensions of an example duplexer in accordance with an embodiment. In the embodiment of FIG. 9, the winding members 220, 222 comprise actively driven rollers mounted on a carrier 226 that is rotatable about a rotational axis 900. As shown, in this embodiment, the surface speed of the winding rollers 220, 222 is greater than or equals the tangential speed of a point on the carrier 226 that is prescribed by the outermost edge of these rollers (point P). Maintaining this speed may reduce instances of the media 210 (FIGS. 2-8) binding on itself. For the surface speed ratio to be the same, the angular velocity ratio is:

$$\frac{\omega_r}{\omega_c} \geq \frac{r_c + r_r}{r_r}$$

$\omega_r$=the angular velocity of the winding members 220, 222

$\omega_c$=the angular velocity of the carrier 226

$r_r$=the radius of the winding members 220, 222

$r_c$=the distance of the center of the winding member 220 (or 222) to the carrier rotational axis 900

In an example, non-limiting embodiment, the radius $r_r$=7.785 mm and the radius $r_c$=12.5 mm to provide an angular velocity ratio $\omega_r/\omega_c \geqq 2.587$. Other dimensions and ratios may, of course, be alternatively employed. The rollers 220, 222, and the carrier 226 may driven by any suitable mechanism. For example, an internal gearing scheme may be utilized.

Pursuant to some embodiments, and as described above, the carrier 226 changes rotational direction between the winding and unwinding operations while the winding members continue in the same direction throughout the process. This may be accomplished by any suitable mechanism. The winding members, in some embodiments, do not change their respective directions of rotation to reduce or prevent media binding. Rotating the winding members in opposite directions, in some embodiments, may limit buildup of tension in the media.

In one example embodiment, a drag clutch swing arm is provided that changes position depending on the direction of rotation of the carrier 226. The different positions of the swing arm drive an idler gear on the swing arm to engage with different idler gears in gear train, thus providing constant forward motion for the winding members 220, 220. Details of this example embodiment are illustrated in FIGS. 10, 11 and are described below.

Figure 10:
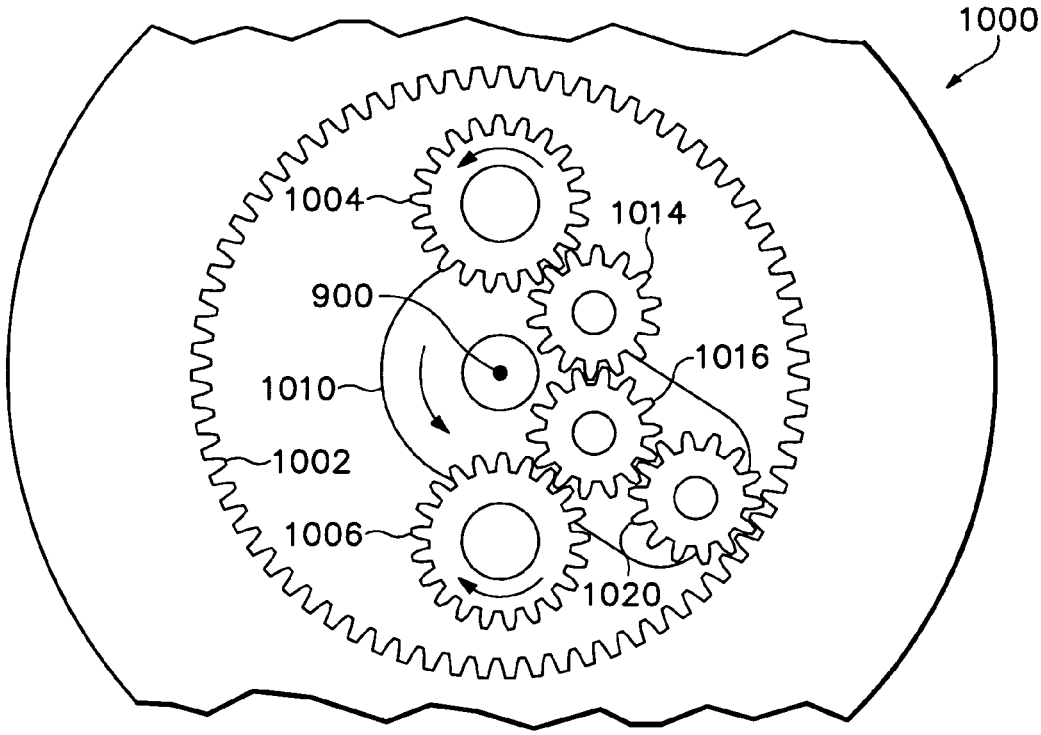
FIG. 10 illustrates an example gear assembly in a media-winding configuration in accordance with an embodiment.
Figure 11:
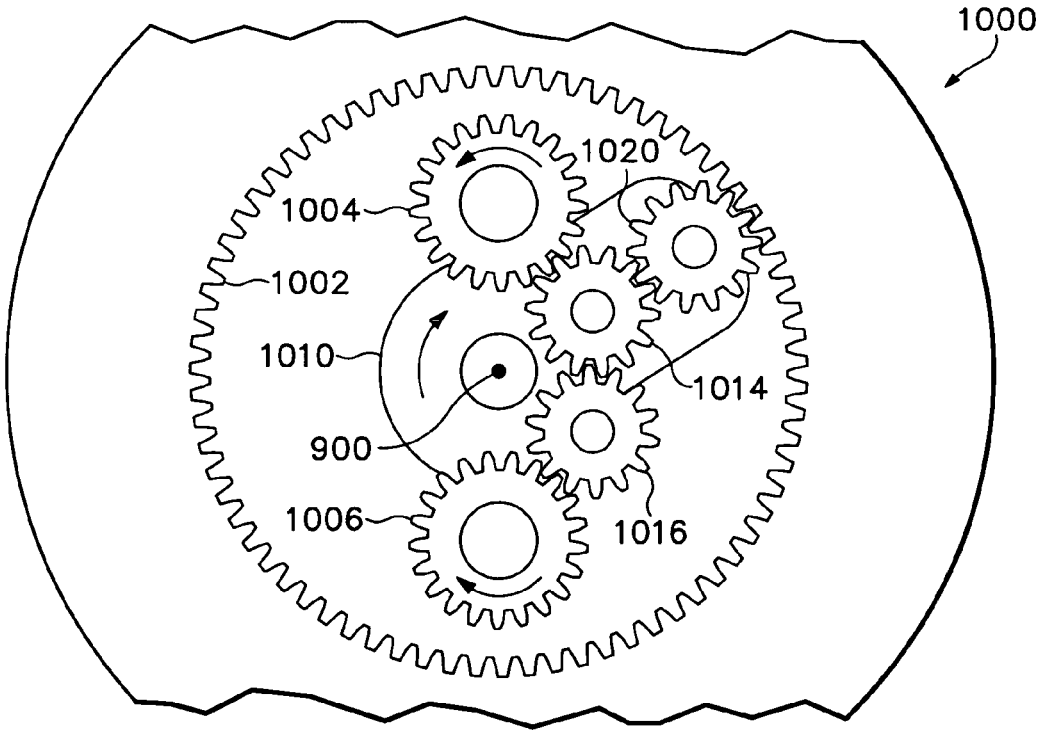
FIG. 11 illustrates an example gear assembly in a media-unwinding configuration in accordance with an embodiment.

FIGS. 10 and 11 illustrate a gear assembly 1000 having a fixed internal gear 1002, driving gears 1004, 1006, and associated idler gears 1014, 1016. FIG. 10 illustrates the gear assembly 1000 in a media winding configuration. FIG. 11 illustrates the gear assembly 1000 in a media unwinding configuration.

As shown in FIGS. 10 and 11, the winding members 220, 222 and carrier 226 are not illustrated to permit clear illustration of the gear assembly 1000. In this example embodiment, the fixed internal gear has 80 teeth and is fixed. The driving gears 1004, 1006 are each connected to and drive an associated one of the winding members 220, 222 (FIGS. 2-8) and may have 23 teeth each. The carrier 226 (FIGS. 2-8) holds both the winding members 220, 222 and the two idler gears 1014, 1016 and is able to rotate about the axis 900. Since there is an even number (2) of idler gears 1014, 1016 between the driving gears 1004, 1006, the winding members 220, 222 counter-rotate with respect to each other.

The swing arm 1010 has a spring loaded idler 1020 and is free to rotate about the axis 900. There are stops (not shown) on the carrier 226, however, that may be employed to limit the rotation of the swing arm 1010 so that it swings between the two idler gears 1014, 1016.

With specific reference to FIG. 10, during the winding operation, the carrier 226 (FIGS. 2-8), which holds the winding members 220, 222 and the idler gears 1014, 1016, rotates counterclockwise. The drag clutch function of the idler 1020 of the swing arm 1010 resists this counterclockwise motion of the carrier 226 and allows the swing arm 1010 to remain stationary until the idler gear 1020 engages with the idler gear 1016 and an anti-rotation stop (not shown) on the carrier 226 is contacted. Further motion of the carrier 226 in the counterclockwise direction creates motion in the driving gears 1004, 1006 gears as indicated in FIG. 10, thus winding and feeding the media.

With specific reference to FIG. 11, during the unwinding operation, the carrier 226 changes rotational direction and begins to rotate clockwise. As before, the drag clutch function in the swing arm 1010 resists motion, so the swing arm 1010 will remain stationary until the swing arm 1010 hits the anti-rotation stop (not shown) on the carrier 226. At that point, further clockwise rotation by the carrier 226 results in the rotation of the driving gears 1004, 1006 as indicated in FIG. 11.

With the swing arm architecture shown in FIGS. 10 and 11, the winding members 220, 222 rotate in the same direction regardless of the direction of rotation of the carrier.

Figure 12:
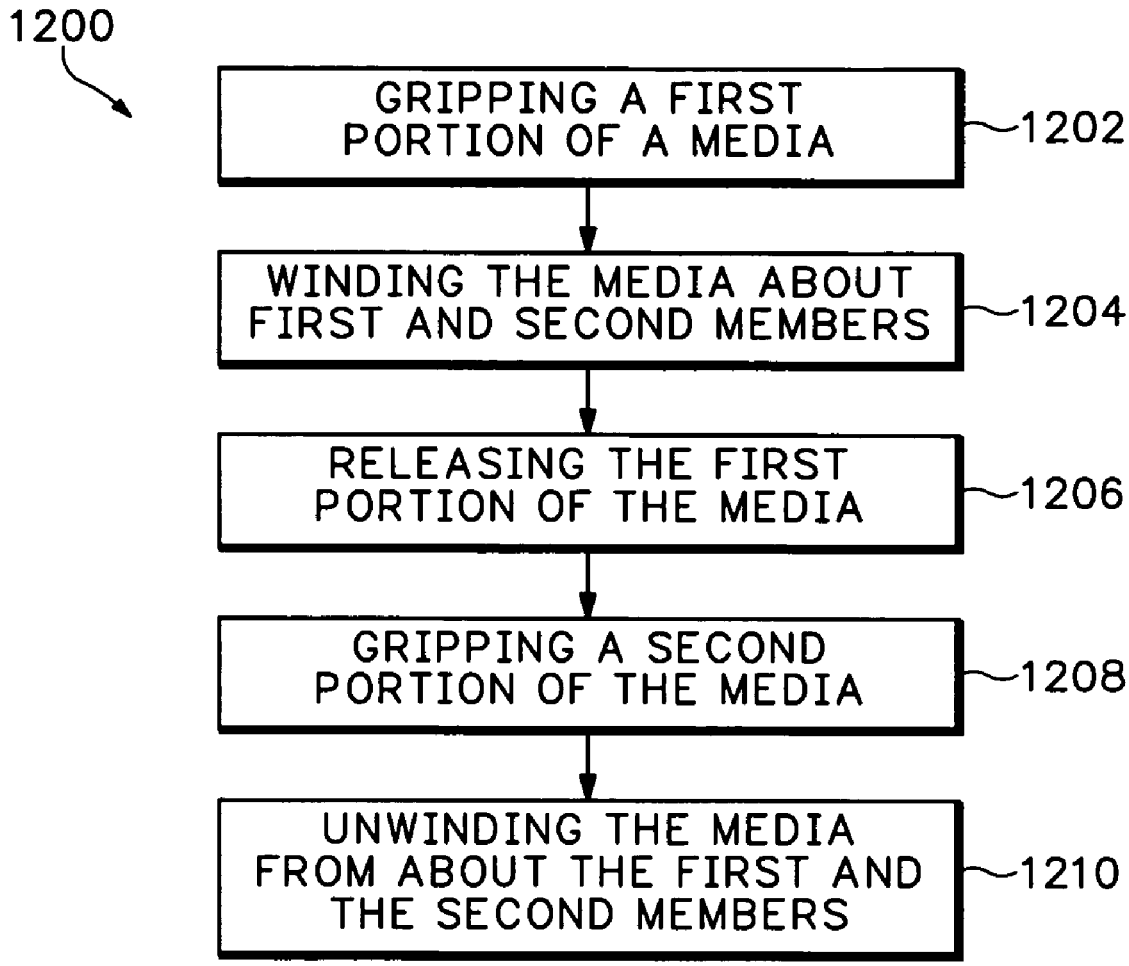
FIG. 12 is a flowchart illustrating an example method in accordance with an embodiment.

FIG. 12 is a flowchart 1200 illustrating an example method. As shown in FIG. 12, at block 1202, gripping a first portion of a media is performed. The gripping of the first portion of the media may be performed, for example, as shown in FIG. 3, where a portion 250 of media 210 is gripped between the rollers 204 and 208. The portion 250 of the media 210 is disposed in the nip between the rollers 204, 208 and the roller 204 is stationary, or stalled, and thus prevents movement of the portion 250 of the media 210.

Winding the media about first and second members is performed at block 1204. FIGS. 4 and 5 illustrate example winding media 210 about winding members 220, 222. The winding members 220, 222, as shown in FIGS. 4 and 5, revolve about common axis and may revolve 180 degrees as shown in FIG. 4, may revolve 360 degrees as shown in FIG. 5, or may rotate other amounts in winding the media 210.

Releasing the first portion of the media is performed at block 1206. As shown in FIG. 6, the roller 204 rotates and thus permits movement, or moves, the portion 250 of the media 210.

Gripping a second portion of the media is performed at block 1208. FIG. 6 shows the portion 252 of the media 210 held, or gripped, between the rollers 202, 206, with the roller 202 held in a stationary, or stalled, position. In some embodiments, the blocks 1206 and 1208 are performed substantially simultaneously. In other embodiments, the block 1208 is performed before the block 1206.

At block 1210, unwinding the media from about the first and the second members is performed. FIGS. 6 and 7 illustrate example unwinding media 210 from about the winding members 220, 22. The winding members 220, 222, as shown in FIGS. 6 and 7, revolve about a common axis in a direction opposite of the direction revolved during the winding.

Although the foregoing has been described with reference to example embodiments, workers skilled in the art will recognize that changes may be made in form and detail without departing from the spirit and scope thereof. For example, although different example embodiments may have been described as including one or more features providing one or more benefits, it is contemplated that the described features may be interchanged with one another or alternatively be combined with one another in the described example embodiments or in other alternative embodiments. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A duplexer, comprising:

first and second members;

the first and second members configured to wind media about the first and second members; and a gripping mechanism spaced from said first and second members, said gripping mechanism for gripping a portion of the media in a stationary position while the first and second members unwind the media about the first and second members.

2. A duplexer, comprising:

first and second members;

the first and second members configured to wind media about the first and second members; and a rotatable carrier, the first and second members coupled to the rotatable carrier such that rotation of the rotatable carrier causes the first and second members to revolve about an axis of rotation of the rotatable carrier.

3. A duplexer, comprising:

first and second members;

the first and second members configured to wind media about the first and second members; and a gripping mechanism for gripping a portion of the media in a stationary position while the first and second members wind the media about the first and second members.

4. A duplexer, comprising:

first and second members;

the first and second members configured to wind media about the first and second members;

a first gripping mechanism configured to hold a first portion of the media during winding; and a second gripping mechanism configured to hold a second portion of the media during unwinding.

5. A duplexer, comprising:

first and second members;

the first and second members configured to wind media about the first and second members; and a rotatable carrier, the first and second members coupled to the rotatable carrier such that rotation of the rotatable carrier causes the first and second members to revolve about an axis of rotation of the rotatable carrier;

wherein the first and second members are fixed to the carrier such that the first and second members do not rotate relative to the rotatable carrier.

6. A duplexer, comprising:

means for gripping a first portion of media;

means for winding the media while the first portion of the media is gripped by the means for gripping, wherein said means for gripping grips the media in a stationary position while the means for winding winds the media.

7. A duplexer, comprising:

means for gripping a first portion of media;

means for winding the media while the first portion of the media is gripped by the means for gripping; and means for gripping a second portion of the media while the means for winding unwinds the media.

* * * * *